US005501362A

United States Patent [19]

Cudzik

[11] Patent Number: 5,501,362

[45] Date of Patent: Mar. 26, 1996

[54] CAN BOTTOM WITH INSIDE OR OUTSIDE SURFACES SECURED TOGETHER BY CIRCULAR WELD OR BOND

[75] Inventor: Daniel F. Cudzik, Chesterfield County, Va.

[73] Assignee: Reynolds Metals Company, Richmond, Va.

[21] Appl. No.: 206,590

[22] Filed: Mar. 7, 1994

[51] Int. Cl.[6] ..... B65D 6/02

[52] U.S. Cl. ..... 220/612; 220/606; 220/633; 220/906

[58] Field of Search ..... 220/612, 605, 220/606, 633, 634, 404, 906

[56] References Cited

U.S. PATENT DOCUMENTS

| | | | |
|---|---|---|---|
| 167,608 | 9/1875 | Gill . | |
| 189,590 | 4/1877 | Wright . | |
| 210,751 | 12/1878 | Chaumont . | |
| 1,031,264 | 7/1912 | Hinde . | |
| 1,701,636 | 2/1929 | Richman | 220/612 |
| 1,718,322 | 6/1929 | Walker | 220/612 |
| 2,339,763 | 1/1944 | Callesson et al. . | |
| 2,541,081 | 2/1951 | Lyon . | |
| 2,576,767 | 11/1951 | A'Hearn | 220/612 |
| 2,759,628 | 8/1956 | Sokoloff | 220/633 X |
| 3,799,423 | 3/1974 | Cvacho . | |
| 3,838,789 | 10/1974 | Cvacho . | |
| 3,912,109 | 10/1975 | Essex, Jr. et al. . | |
| 4,010,867 | 3/1977 | Jones . | |
| 4,378,328 | 3/1983 | Przytulla et al. . | |
| 4,426,013 | 1/1984 | Cherchian | 220/906 X |
| 4,768,672 | 9/1988 | Pulciani et al. | 220/606 |
| 5,069,052 | 12/1991 | Porucznik et al. . | |

FOREIGN PATENT DOCUMENTS

| | | |
|---|---|---|
| 1238872 | 7/1988 | Canada . |

*Primary Examiner*—Steven M. Pollard
*Attorney, Agent, or Firm*—Robert C. Lyne, Jr.

[57] ABSTRACT

A thin walled metal container is formed with a bottom wall having a substantially flat central panel connected to a container side wall through an annular rest radius defining an annular support surface for the container. The annular rest radius includes an outer connecting web portion leading into the container side wall and an inner connecting web portion leading into the central panel. In the preferred embodiment, these connecting web portions are permanently joined to each other by welding or adhesive bonding to resist column loading forces acting through the side wall and internal pressure forces acting through the central panel which have the effect of unrolling the annular rest radius. Since these curved opposing portions of the rest radius are immobilized to resist column and internal pressurization, a thinner gauge metal can be used to satisfy design parameters and achieve cost and metal reduction savings. A method of reforming an annular rest radius in the bottom wall of a drawn and ironed container is also disclosed.

20 Claims, 6 Drawing Sheets

CAN BOTTOM WITH INSIDE OR OUTSIDE SURFACES SECURED TOGETHER BY CIRCULAR WELD OR BOND

TECHNICAL FIELD

The present invention relates to thin-walled metal cans having a cylindrical side wall and a bottom integral therewith, and, more particularly, to such can bottoms.

BACKGROUND ART

Today's market for metal beverage cans is extremely price competitive, which necessitates making the cans from the least amount of metal possible while still providing the necessary structural integrity. By using state of the art manufacturing techniques it is now possible to manufacture a 12-ounce aluminum can having a thin side wall, e.g. , about 0.0040–0.0045 inch thick, with the side wall increasing in thickness at its upper end to about 0.0070–0.0075 inch to permit the forming of a can neck without collapsing or wrinkling the side wall. New necking processes are expected to yield metal and cost reduction in the neck region of the can. An example of such a process is the spin flow process disclosed in U.S. patent application Ser. No. 07/929,932, filed Aug. 14, 1992, and issued to the present assignee, Reynolds Metals Company. U.S. Pat. No. 4,781,047 issued to Ball Corporation also pertains to a spin flow process.

Notwithstanding the technological advances which have resulted in metal savings in the neck region of the can, the can bottom continues to be manufactured with a thickness of about 0.012 inch (which actually varies somewhat across different parts of the bottom due to drawing action), which means that about one-third of the weight of the metal in the can must be in the bottom, to provide the necessary structural integrity. The can bottom must be able to sustain a column load of approximately 250 pounds during a spin flow necking process and 300 pounds during a die necking process. Later, it must sustain a column load of about 135 pounds when a can end is double-seamed on the can body after it has been filled with product. Another design criterion is a drop test for shock loads, in which the filled and seamed can must be able to resist a drop of about five inches without bottom reversal or increase in can height. In addition, a can filled with a carbonated beverage must be able to contain an internal pressure of about 40–100 psi.

To meet these requirements, conventional industry practice is to form the relatively thick bottom to have a profile with a concave or hollow central region. The bottom is formed into its final, inwardly domed shape between a hollow die engaging the internal surface of the bottom from the interior of the can and a punch engaging the external surface of the bottom. Cooperation of the punch and die creates a bottom having an inner wall at the outside of the concave region, an outer wall connected to the can side wall, and a rest radius connecting these two inner and outer walls.

The resistance of the inwardly domed portion to outward bulging under internal pressure is greatly influenced by the size of the rest radius. The smaller the rest radius, generally the higher the internal pressure resistance of the can. Too large a radius will reduce this pressure to an unacceptable level. However, this conventional forming process works best if the rest radius is large, because during the process the sheet metal is pulled radially inward into the hollow region and, as viewed in profile, snakes around the radius on the punch and die. Too small a radius will create a fracture or thickness reduction. Thus, these two competing factors require compromise. Although advances are presently being made by the present assignee and others to reduce the rest radius of can bottoms to increase their bulge strength and thereby reduce their thickness, this approach inherently requires that the overall strength of the can bottom is dictated by mechanical features in the bottom.

U.S. Pat. No. 5,105,973, which issued Apr. 21, 1992 to Ball Corporation, contains a comprehensive discussion of inwardly domed can bottoms and the phenomena of dome reversal and roll-out (i.e., unrolling of inward profiles) caused by internal pressure, increases in overall can height resulting from this type of failure, and ways to strengthen inwardly domed can bottoms without unacceptably decreasing the internal volume of the can. See also U.S. Pat. Nos. 4,722,215 and 4,885,924 issued to Metal Box p.l.c., which concern reforming inwardly domed can bottoms in an additional operation, and U.S. Pat. Nos. 4,177,746 and 4,222,494 issued to Reynolds Metals Company, the assignee hereof.

It is an object of the present invention to reduce the thickness of the metal in a can bottom without significantly affecting the structural integrity of the can.

Another object is to reduce the metal in the can bottom to a thickness of approximately 0.0070 inch to thereby reduce its weight by approximately 30% while still enabling the can to satisfy design requirements.

Yet a further object of the invention is to provide a can bottom formed without inwardly curved mechanical features.

A further object is to provide a can bottom wherein the tensile strength of the metal provides sufficient strength to satisfy the design requirements.

SUMMARY OF THE INVENTION

For clarity and consistency, some of the terms used in the specification and the claims hereof will now be defined. "Can" and "container" are used interchangeably. "Can end" or "lid" means a closure which is, or is intended to be, affixed to a can body containing a product. When the product is a beverage, the can end and can body are typically sealed together at a circular double-seam. Directional terms such as "upper", "lower", "side", "horizontal", and "vertical" refer to cans, can bodies, and can ends as though they are resting upright on a horizontal table. It will be understood, however, that the can bodies may be, and probably will be, in different orientations as they are being manufactured. "Axis" and "axial" refer to the longitudinal axis of the can body, and "radial" and "radially" relate to that axis. "Profile" means the profile of a can end or can body as viewed in a cross-section taken along its longitudinal (vertical) axis. "Radius" refers to a curve in the profile of the can body. The "rest surface" of a can body is the line or area at its very bottom which contacts a horizontal surface when the can body is resting upright on the surface.

A metal container, according to the present invention, comprises a bottom wall and a cylindrical side wall extending from the bottom wall to define an open end which is adapted to be closed with a can end. The bottom wall includes a preformed central portion and an annular rest radius connecting the central portion to the side wall and defining an annular support surface for the container. Opposing portions of the annular rest radius, respectively located at opposing positions to each other, relative to the annular support surface, are connected together at a point other than the annular support surface, to resist outward bulging of the bottom as a result of internal pressurization, as well as resist column loading forces acting through the side wall, both of which have the effect of unrolling the annular rest radius.

Therefore, in a preferred embodiment of the present invention, the bottom wall is otherwise formed without inwardly curved, mechanical features which would be susceptible to unrolling by metal reversal as a result of carbonation pressure within the filled and sealed container. This is because these curved mechanical features defining the rest radius are immobilized by being adhesively bonded or welded together. The central panel is preferably flat. The unique bottom wall construction of this invention is believed to make it possible to utilize a thinner gauge metal, such as 0.007 inch thick as opposed to a conventionally used metal 0.012 inch thick, to achieve corresponding metal and cost reduction savings.

The annular rest radius includes an outer connecting annular web portion leading into the container side wall and an inner connecting annular web portion leading into the bottom central portion. These web portions are permanently joined to each other through welding or adhesive bonding. This permanent joint is located between the container side wall and bottom central portion on the one side, and the curved annular bottom wall portion defining the annular support surface of the rest radius on the other or lower side of the joint. In this manner, the joint isolates the curved annular bottom wall portion of the rest radius from column loading forces and internal pressurization forces.

The metal container according to the preferred embodiment is preferably manufactured as a drawn and ironed container wherein the annular rest radius and central panel of the bottom wall are punch formed at the bottom of the forming stroke. Thereafter, a pair of reform rolls are used to press the inner and outer connecting web portions together. Subsequently, welding rolls may be used to permanently join the webs together. Alternatively, adhesive bonding material can be used to form the permanent joint.

A method of making a metal container body, in accordance with the invention, comprising the steps of forming, from a single piece of metal sheet, a can body having a bottom wall and a side wall extending substantially axially from the bottom wall, by advancing the metal sheet through a series of drawing and ironing rings and punching into the bottom wall at the end of the advancing stroke an annular rest radius connecting a central portion of the bottom to the container side wall. Opposing portions of the annular rest radius are then connected to each other, other than at an annular support surface of the container where these opposing portions are joined. This annular support surface is located along an underside of the annular rest radius.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BEST MODE FOR CARRYING OUT THE INVENTION

The present invention is concerned with cylindrical, one-piece beverage container bodies having a bottom integral with its side wall and made of a relatively thin sheet material such as aluminum or steel. Exemplary containers which may benefit from the present invention are 12-ounce beverage containers made from one piece of sheet aluminum having an initial thickness of 0.012 inch. However, it is contemplated that the inventive concepts may be employed in containers made from various materials and with various other dimensions. The sheet is conventionally formed using drawing and ironing equipment, as is well known to one of ordinary skill in the can manufacturing art. This will result in a cylindrical container side wall having a thickness in the range of 0.004–0.0045 inch over most of its height and between 0.0070–0.0075 inch in the upper end portion thereof (not shown) which is adapted to be necked by necking apparatus as is well known. As will be seen below, the beverage containers of the present invention may be manufactured with a relatively thin bottom wall having a thickness of, for example, approximately 0.0060–0.0075 inch, as opposed to conventional thicknesses of 0.012 inch. This is because the bottom wall does not depend upon inwardly curved, mechanical features for its bulge resistance, so that the physical properties of the metal in the bottom wall are utilized to satisfy design requirements. That is, it is substantially the tensile strength of the metal (e.g., aluminum has a tensile strength of approximately 40,000 psi) which cooperates with the unique form of the bottom wall to provide the container with the necessary structural integrity.

Figure 1:
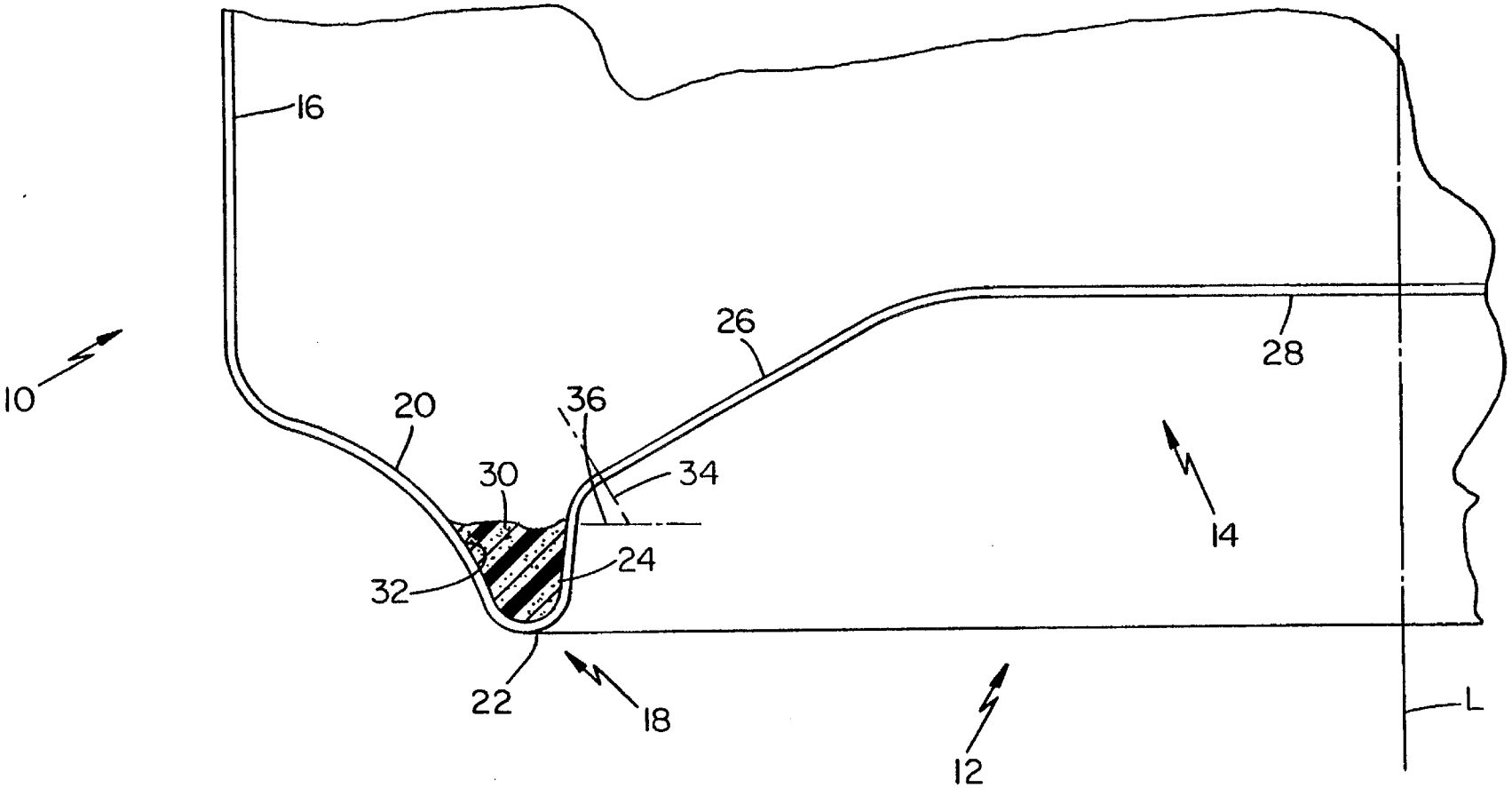
FIG. 1 is an illustration of a conventional container bottom in which the bottom rest radius is immobilized with epoxy in accordance with one embodiment of the present invention.

FIG. 1 is an illustration of a portion of a two-piece metal beverage can 10 which is typically formed with a can bottom 12 having an inwardly domed portion 14 connected to the can side wall 16 through a rest radius, generally designated by reference numeral 18. Rest radius 18 is defined by a radially outer conical or curved wall 20 extending between the side wall 16 and the lower annular support surface 22 of the rest radius 18, and a radially inner wall 24 projecting upward from support surface 22 to connect with an inclined annular wall portion 26 extending radially inward to join central panel 28. The rest radius 18 therefore projects downward from the central panel 28 to define annular support surface 22 enabling the can 10 to rest on a flat horizontal surface to support the can during use. This rest radius 18 is also radially located in relation to the central longitudinal axis L of the can 10 so as to define a nesting surface capable of interfitting with the neck of another metal beverage can positioned adjacent and below such as during storage.

The inward countersink dome 14 is subject to outward buckling as a result of the internal pressure within the filled can since, under high internal pressure, the rest radius 18 tends to "unroll," thereby causing this undesirable outward bulging of the dome to occur. This rest radius 18 also tends to unroll under high column loading pressures being exerted through the container side wall 16 such as during necking of the container open end or subsequent filling of the necked-in container. For these reasons, a can bottom having the foregoing characteristics is typically formed with heavier metal thickness (e.g., 0.012 inches) than in the side wall 16 (e.g., 0.006 inches) to ensure that the can retains its flat resting surface while under pressure without unrolling.

To prevent undesirable reversal of the bottom dome 14, in accordance with the FIG. 1 embodiment of the present invention, an epoxy resin 30 is disposed inside the can bottom 12 so as to partially or completely fill the annular internal cavity 32 (defined by walls 20,24) of the rest radius 18. Once cured, this epoxy resin 30 essentially "immobilizes" the outer and inner curved annular portions 20,24 of the rest radius 18 by adhesively fixing or bonding them together to prevent unrolling during force application tending to cause metal reversal. Experiments have shown that the buckling capability of the conventional can bottom increases by approximately 30% since the panel radius 34 leading into the countersunk dome 14 from the rest radius 18 is immobilized and cannot unroll at the rest radius at its line of intersection 36 therewith. It is theorized or expected that this type of immobilization advantageously enables down-gauging of the metal bottom thickness from 0.012 inches, for example, to about 0.006–0.008 inches.

Figure 2:
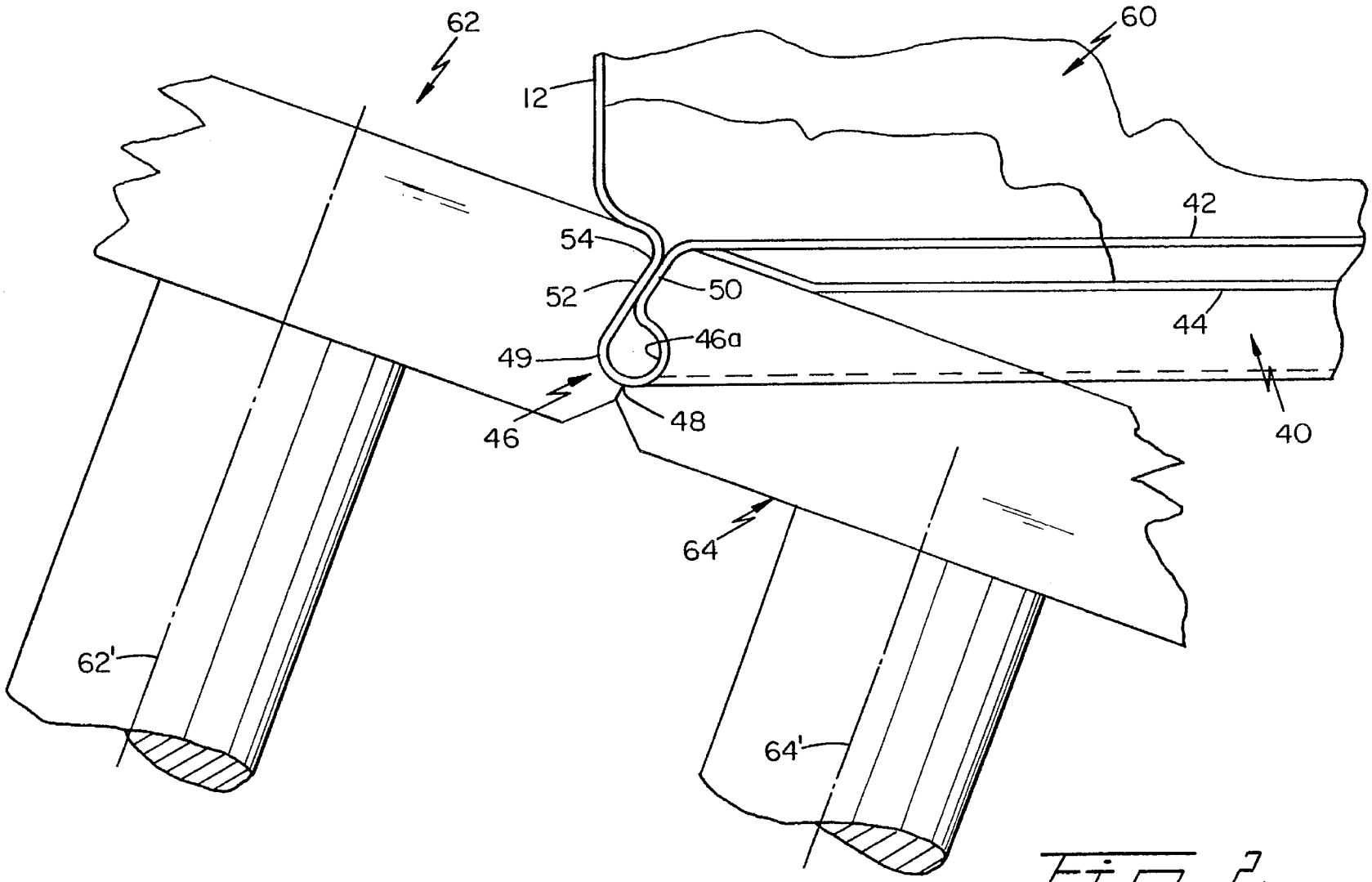
FIG. 2 is a sectional view of a metal container bottom made in accordance with the preferred embodiment of the present invention, with the bottom reform rolls depicted in operative positions for reforming the rest radius.

In accordance with a preferred embodiment of the invention, FIG. 2 is an illustration of a new metal can bottom 40 which is formed with a flat bottom panel 42 or a concave bottom panel 44 and an annular rest radius 46 projecting downwardly from the bottom panel 42 or 44 to define an annular bottom rest surface 48 for supporting the can during use. This annular rest radius 46 is in the form of a hollow ring 49 having an inner connecting web 50 inclined upwardly and leading into the periphery of the can bottom 42 or 44, and an outer web 52 extending upwardly and leading into the container side wall 12. These webs 50,52 are connected together, preferably along their entire extent, with a bonded or welded lap joint 54. This "permanent joint", i.e., bonded or welded, performs the function of locking the inner and outer connecting webs 50,52 to each other to prevent reversal of the can bottom 40 or collapsing of the container side wall 12 as a result of unrolling of the outer web portion under necking, seaming, or filling loads.

Figure 3:
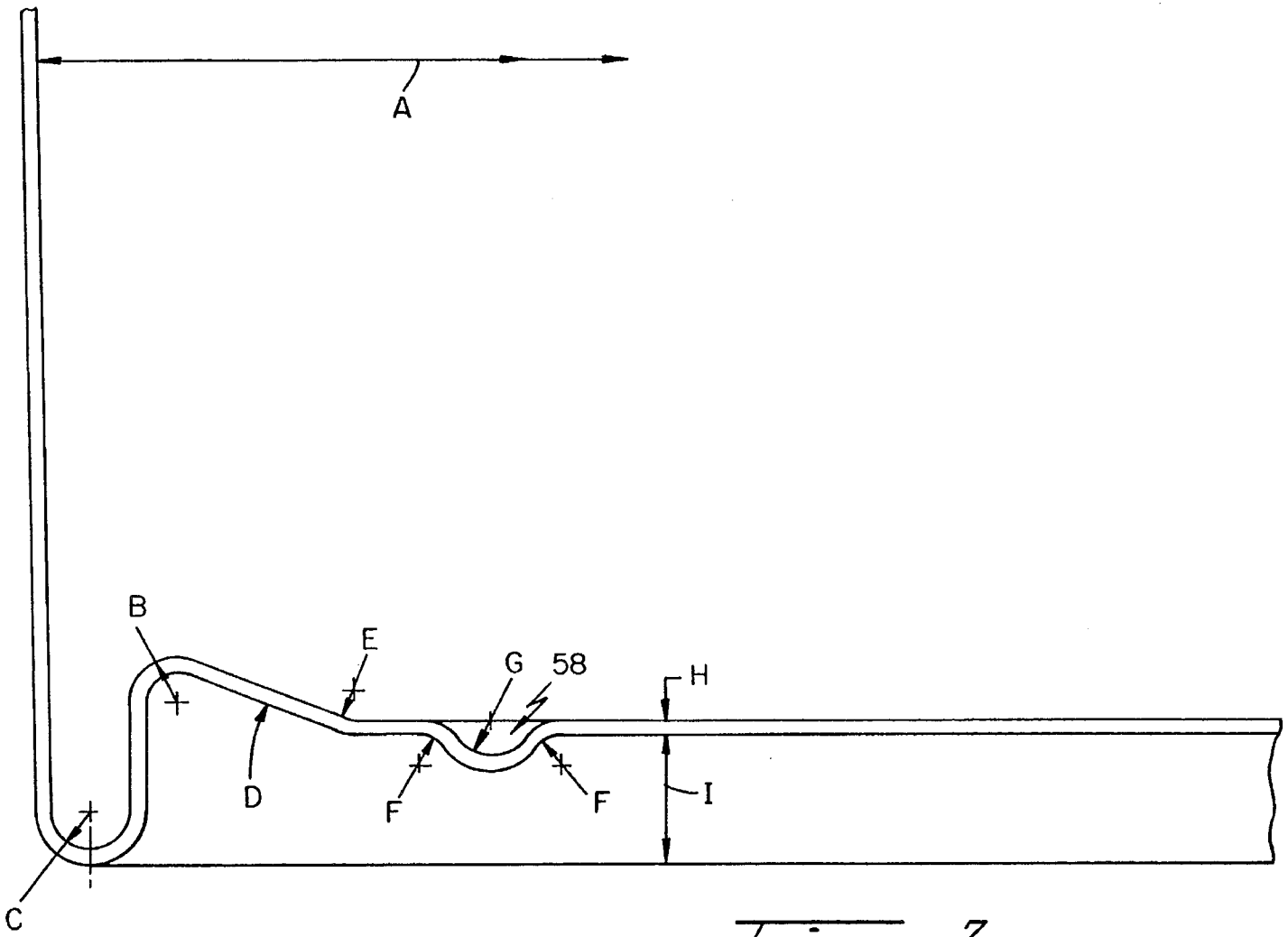
FIG. 3 is a sectional view of a drawn and ironed container depicting the container bottom features of the preferred embodiment as an intermediate product prior to reforming into the final configuration of FIG. 2.

FIG. 3 is an illustration of a can prior to being reformed into the new container bottom 40 of the preferred embodiment of this invention. The can of FIG. 3 is an intermediate product which may be formed in a drawing and ironing press in a known manner. The punch is formed with a profiled punch face adapted to cooperate with bottom die forming elements in a known manner to draw and form an annular rest radius having the profile depicted in FIG. 3. The punch is further formed with a circumferential array of forming pins adapted to form a series of downward facing stacking projections 58 (not shown in FIG. 2) at radially inwardly equispaced locations from the annular rest radius 46.

A can bottom wall having the foregoing features as an intermediate product, in accordance with the present intention, advantageously allows the can body to be manufactured by existing drawing and ironing equipment wherein the punch tooling is modified in the manner described above to obtain the appropriate features. That is, the can is first drawn to essentially a cylindrical shape as is well known. On impact with base reform tooling, the bottom is reversed upwardly inward to form the annular rest radius 46 together with the circumferentially spaced stacking projections 58 or feet. These features are advantageously added to the can bottom during the reform action. This is because if the features were added onto the punch or on the cup when running the punch through the drawing and ironing rings, the can would very likely be torn apart. Therefore, the foregoing features are essentially preferably formed in the bottom wall at the bottom of the stroke after the can has been completely drawn and ironed and they are induced into the metal bottom in the reform upward stroke. Given the foregoing description of the can bottom wall geometry, the features of the invention may be formed with minor modifications to the existing tools as will now occur to one of ordinary skill in the art upon review of this disclosure.

The intermediate can body product of FIG. 3 is forced into its final bottom configuration of FIG. 2 at a reform station provided with a mandrel 60 inserted into the can to engage the inner surfaces of the can bottom and side walls 42 and 12 and to position the annular rest radius of the can bottom wall between a pair of reform rolls 62 and 64 having the profile characteristics depicted in FIG. 2. The outside and inside reform rolls 62,64 having the profiled peripheries are respectively rotatable about parallel axes of rotation 62' and 64' which are inclined at a predetermined angle (e.g., 20.5°) from the can bottom 42 or 44 and are adapted to be indexed towards each other to respectively contact the outside and inside exterior surfaces of the rest radius 46 to reform the metal into the "teardrop" configuration of FIG. 2. FIG. 2 may be considered to be a scaled representation of the reform roll profiles.

Figure 4:
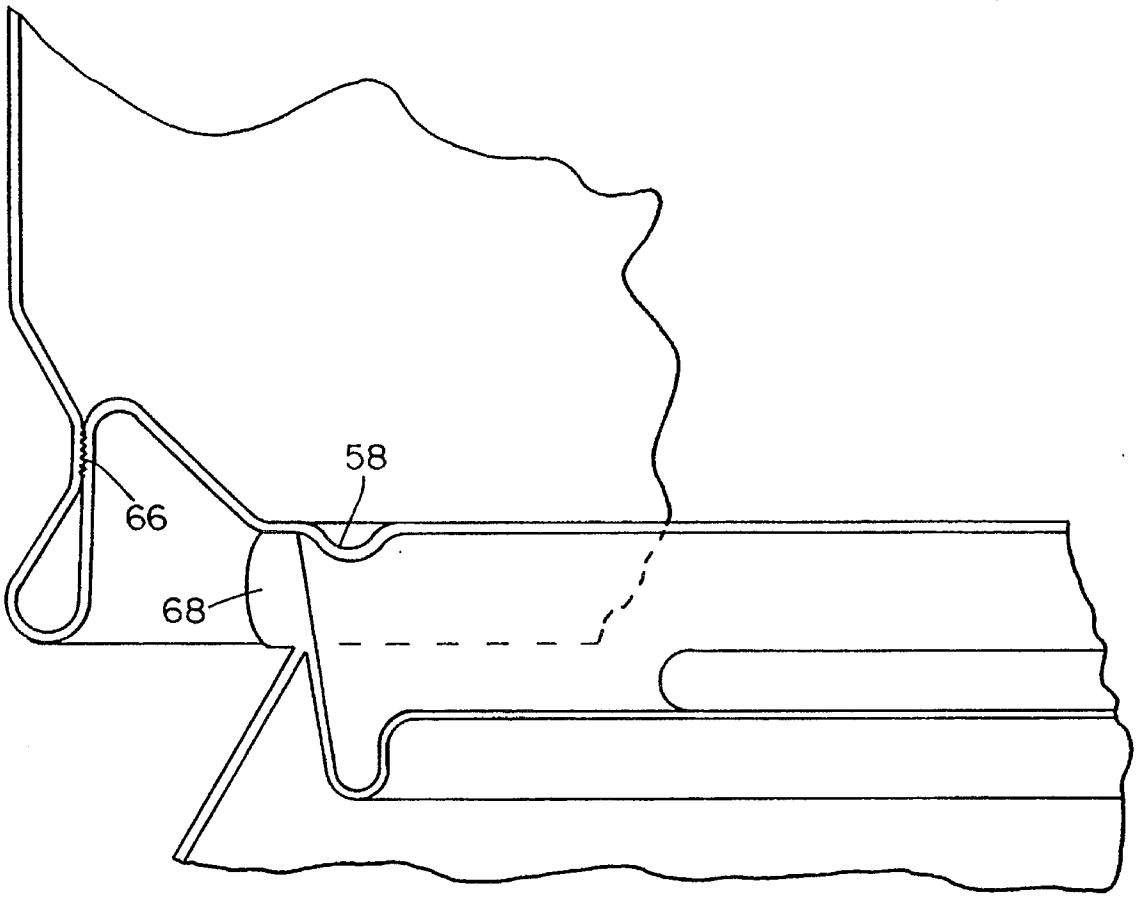
FIG. 4 is a sectional view of an alternate preferred embodiment.

FIG. 4 is an alternative preferred embodiment wherein the permanent joint 66 (i.e., adhesive bond or weld) extends in a vertical plane. FIG. 4 also depicts the manner in which vertically adjacent cans stack in relation to each other utilizing the novel bottom stacking features 50 of this invention. FIG. 4 is also a scaled representation of the alternative preferred embodiment.

Subsequent to reforming, the reformed can is indexed to a welding station wherein a pair of welding rolls (not shown) engage the inner and outer connecting webs 50,52 to roll the bottom and weld the webs together with a resistance weld. In the preferred embodiment, this would result in a welded or adhesive bonded surface having an extent of approximately 0.050–0.055 inches, preferably 0.053 inches. It is unnecessary to obtain 100% welding or adhesive bonding integrity to obtain the mechanical benefits of this invention. It is theorized that a welding integrity of about 95% is sufficient. Alternatively, it is theorized that intermittent welds may be sufficient. Further, since the can interior is coated in a subsequent conventional process, the coating will tend to result in a complete seal between the inner and outer connecting webs 50,52 to prevent the container contents from entering the resulting annular chamber **46*a* formed in the permanently joined rest radius. From the foregoing, it can be seen that the present invention has applicability to can bottom geometries having profiles which are capable of unrolling under internal carbonation pressures (i.e., buckling) or under necking and seaming column loads acting downwardly through the can side wall to cause reversal of the profiled bottom geometries. As is well known, such reversal usually occurs within the can bottom rest radius. Therefore, although this invention is primarily applicable to immobilizing reversal of the rest radius by welding or otherwise permanently joining together its inside and outside curved portions, this invention may also have applicability in connection with the immobilization of other bottom profile geometries capable of unrolling or reversal as a result of buckling and other pressures. The feature of immobilizing the rest radius 46 advantageously allows the welded or permanently joined radius to be located in substantial vertical alignment with the can side wall 12 which results in improved column strength. This immobilized rest radius 46 may be advantageously relocated in the manner described hereinabove since the entire can bottom 42 or 44 located within the confines of the immobilized rest radius is substantially flat (42) or concave (44), relative to the can interior, and therefore does not have a bottom geometry profile capable of unrolling as a result of internal container pressures. Stated differently, the immobilized rest radius 46** does not support a dome in the can bottom which is capable of collapsing or reversal as occurs in a conventional can bottom commonly used in the industry.

The stacking projections 58 perform the function of providing stacking support in relation to an adjacent below can of a stack by nesting against the internal periphery of a can end 68 as best depicted in FIG. 4. In the conventional can bottom, this nesting/stacking function was performed by the rest radius. However, as can open ends continue to be necked-in to allow for use of smaller and smaller can ends (which is made possible by new necking technologies such as "spin flow" necking which is a new necking process as disclosed in U.S. patent application Ser. No. 07/929,932, filed Aug. 14, 1992, entitled "Spin Flow Necking Apparatus and Method of Handling Cans Therein", by Harry W. Lee et al, assigned to the assignee, Reynolds Metals Company, Richmond, Va., which shows particular promise for achieving metal and cost reduction in the neck region of the can), the conventional can bottom geometry and rest radius therein must be relocated into radially inward positions so as to provide support for the smaller necked-in container top. However, as the rest radius of a conventional can bottom is moved into radially inward positions, it provides less support for the can side wall which disadvantageously results in reduced column strength. This problem is advantageously avoided with the immobilized or permanently joined rest radius 46 of the present invention in combination with the separate stacking projections 58 which are ideally suited for containers having small necks (e.g., 202 and smaller using canmaker's conventional terminology).

Figure 5:
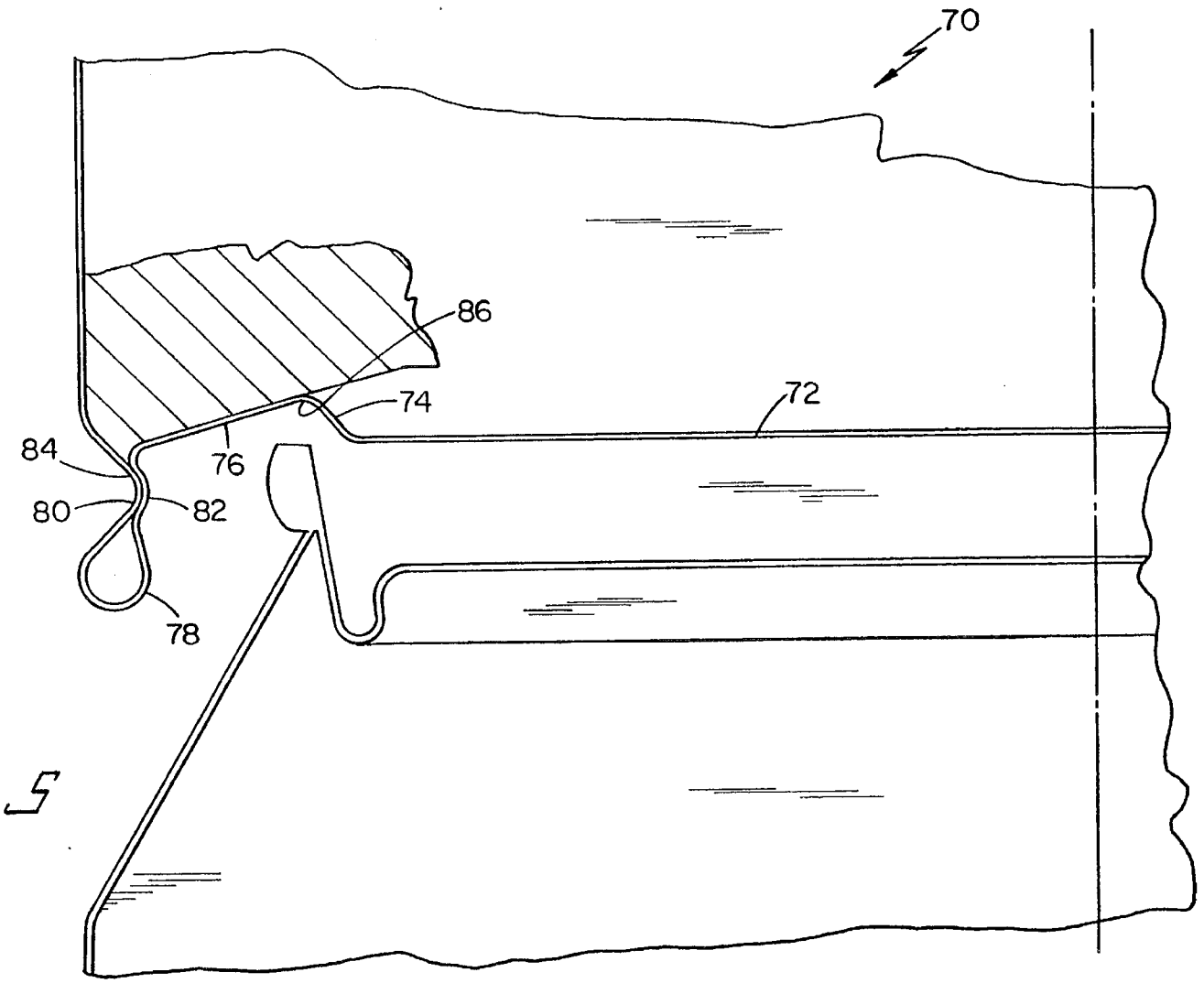
FIG. 5 is a sectional view of another alternate preferred embodiment.

FIG. 5 is an illustration of another embodiment of the invention wherein a can 70 is formed with a can bottom having a flat central panel 72 formed with a short radially upwardly and outwardly extending annular wall 74 leading into a longer radially outwardly and downwardly extending wall 76 terminating in an annular rest radius 78 through a pair of connecting web portions 80 and 82 having a radiused welded or bonded lap joint 84 therebetween. The downward facing surfaces of walls 74 and 76 define an annular concave nesting surface 86 adapted to receive the upper surface of an adjacent below can in stacking relationship.

The feature of forming the weld 84 along a radiused area results in a greater bonding area than the weld achieved in either the FIGS. 2 or 4 embodiments. In addition, since the radiused profile weld 84 is formed on the outside surface of the resting radius 78, reforming of the outside metal induces less stress in the metal than would occur if the inside metal of the rest radius was reformed, i.e., forming an oppositely or outwardly curved lap joint.

Figure 6:
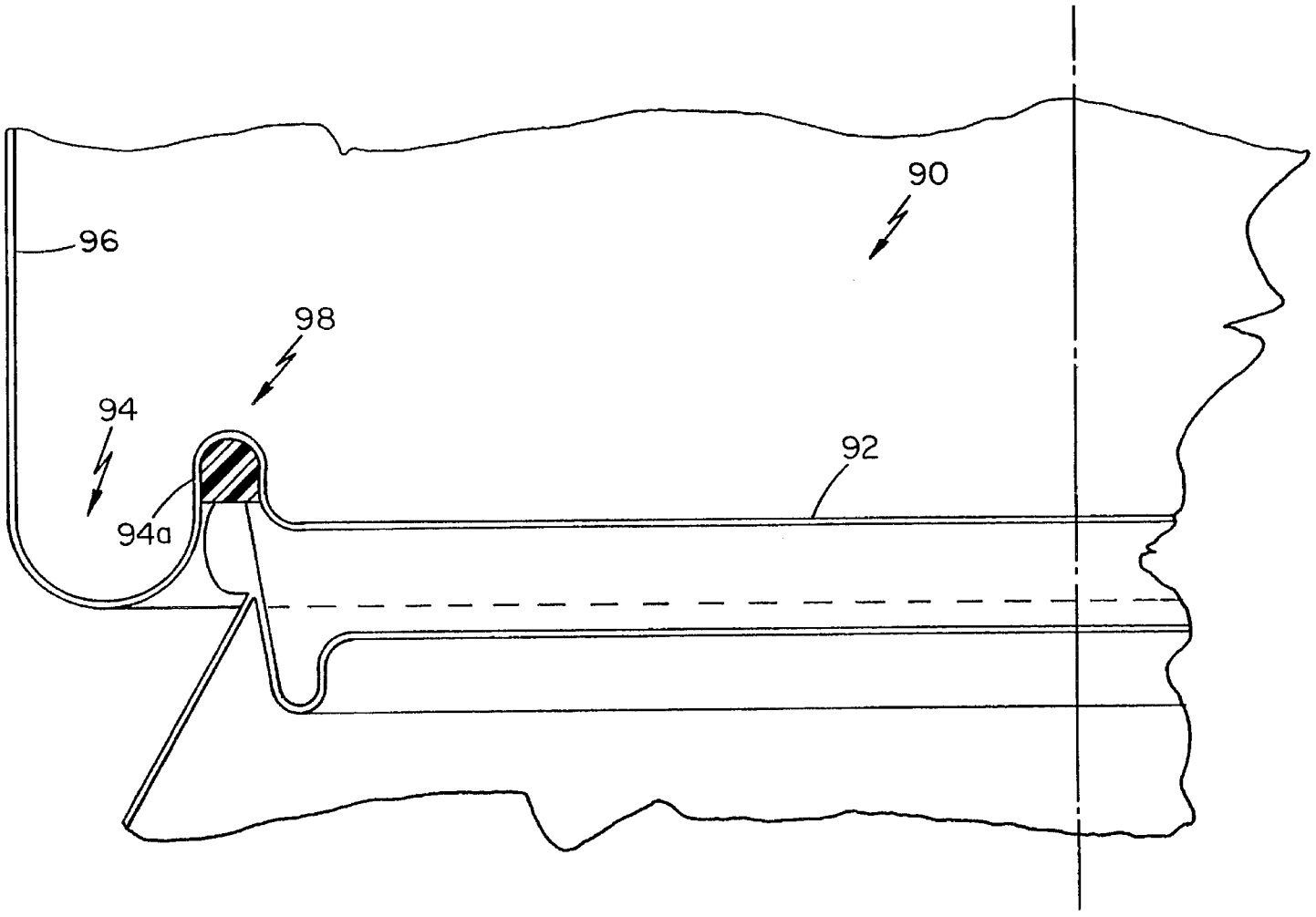
FIG. 6 is a sectional view of yet another embodiment of the invention.

FIG. 6 is an illustration of another embodiment of the invention wherein a can 90 is formed with a flat bottom central panel 92 and an annular resting radius 94 located radially outwardly adjacent the can side wall 96. The periphery of the central bottom panel 92 is connected to the inner curved wall portion 94*a* of resting radius 94 by means of an annular radiused projection 98 projecting upwardly into the can interior from the interior surface of central panel 92. The resulting downward facing, annular recess formed in the exterior bottom surface of the can is filled with an epoxy resin which serves to isolate the resting radius from the central panel 92 to prevent undesirable metal reversal from one to the other. This downward facing annular recess also provides stacking support receiving the upper surface of a can bottom of an adjacent below can in stacking relationship.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

What is claimed is:

1. A metal beverage container, comprising a bottom wall and a drawn and ironed (D&I) side wall extending substantially axially from the bottom wall to define an open end of the container, said bottom wall and said side wall being of one piece construction, said bottom wall including an annular rest radius having an outer connecting web portion leading into the side wall and an inner connecting web portion leading into a central panel of the bottom wall, said rest radius defining an annular support surface for the container located below the inner and outer connecting web portions, said inner and outer connecting web portions being permanently joined to each other at least at intermediate portions thereof.

2. The container of claim 1, wherein said web portions are welded together.

3. The container of claim 1, wherein said web portions are adhesively bonded together.

4. The container of claim 1, wherein said web potions are permanently joined in at least one of a bonded and a welded lap joint.

5. The can of claim 4, wherein said lap joint formed by juxtaposed parts of said inner and outer connecting web portions is defined by a radius of curvature and is thereby curved in cross-sectional profile view.

6. The can of claim 5, wherein said curvature of the lap joint is concave when viewed from the side of the can facing toward the can side wall.

7. The container of claim 4, wherein said lap joint extends generally parallel to the container side wall.

8. The container of claim 1, wherein said web portions are permanently joined over at least 95% of their circumferential extent or intermittently joined by spot welds located at circumferentially spaced intervals.

9. The container of claim 1, wherein said central panel is formed as a substantially flat panel member including a plurality of stacking projections as the only curved profiled features therewithin.

10. The container of claim 1, wherein said annular rest radius is a ring-shaped member located below the inner and outer web portions.

11. The container of claim 1, wherein said annular rest radius is in substantial vertical alignment with the container side wall.

12. A metal beverage container, comprising a bottom wall and a drawn and ironed (D&I) side wall extending substantially axially from the bottom wall to define an open end of the container, said bottom wall and said side wall being of one piece construction, said bottom wall including a central portion and an annular rest radius connecting the central portion to the side wall and defining an annular support surface for the container, wherein opposing portions of the annular rest radius respectively located at opposing positions to each other relative to the annular support surface, are connected to each other along a predetermined axial extent, at least at intermediate portions thereof to resist column loading forces acting through the side wall and internal pressure forces acting through the central portion each of which have the effect of unrolling said opposing portions.

13. The can of claim 12, wherein said opposing portions are connected to each other with an adhesive material within the can interior which occupies an annular region formed by and between said opposing portions.

14. The can of claim 12, wherein said adhesive material is an epoxy resin which substantially entirely fills said annular region.

15. The can of claim 12, wherein said opposing portions are pressed into permanently joined contact with each other.

16. The can of claim 15, wherein said opposing portions are welded together.

17. The can of claim 12, wherein the nominal thickness of the can bottom is approximately 0.006–0.007 inch.

18. A metal can, comprising a bottom wall, having a substantially flat central panel, and a drawn and ironed (D&I) side wall joined together through an annular resting radius formed radially adjacent the side wall, said bottom wall and said side wall being of one piece construction, and an inverted, radiused annular projection extending upwardly into the can interior around the periphery of the central panel radially inwardly adjacent said resting radius, said annular projection defining an annular, downward facing recess in the bottom surface of the bottom wall, wherein opposing outer and inner wall portions of the annular projection respectively connected to the annular resting radius and the central panel are permanently joined together at points of attachment spaced within the recess, at least at intermediate portions thereof.

19. The can of claim 18, wherein permanent joining occurs with a resin disposed in said downward facing annular recess.

20. A metal can, comprising a bottom wall having a substantially flat central panel portion and an annular resting radius connecting the central panel portion to a can side wall, said central panel portion and said sidewall being of one piece construction and being connected by curved walls portions, an improvement wherein said curved wall portions disposed between the central panel portion and said side wall are permanently joined to each other through at least one of welded and bonded points of attachment along a predetermined axial extent, at least at intermediate portions thereof relative to a longitudinal can axis.

* * * * *